US008376766B1

(12) United States Patent
Huettner et al.

(10) Patent No.: US 8,376,766 B1
(45) Date of Patent: Feb. 19, 2013

(54) CONNECTOR WITH COMPLIANT SECTION

(75) Inventors: Cary M. Huettner, Rochester, MN (US); Joseph Kuczynski, Rochester, MN (US); Robert E. Meyer, III, Rochester, MN (US); Mark D. Plucinski, Rochester, MN (US); Timothy J. Tofil, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/211,086

(22) Filed: Aug. 16, 2011

(51) Int. Cl.
*H01R 13/64* (2006.01)

(52) U.S. Cl. ..... 439/248

(58) Field of Classification Search ..... 439/248, 439/247, 62, 637, 61, 274
See application file for complete search history.

(56) References Cited

U.S. PATENT DOCUMENTS 3,587,029 A * 6/1971 Knowles ..... 439/607.34
5,415,571 A 5/1995 Lutsch
5,967,856 A * 10/1999 Meller ..... 439/700
7,708,578 B1 * 5/2010 Lenox ..... 439/248

* cited by examiner

*Primary Examiner* — Edwin A. Leon
*Assistant Examiner* — Harshad Patel
(74) *Attorney, Agent, or Firm* — Rabin & Berdo, P.C.

(57) ABSTRACT

An apparatus, method and computing device including a card edge contact system is provided. A card edge connector housing for receiving a card is provided. A substrate is provided and spaced a distance away from a housing base portion of the card edge connector housing to form a space therebetween. Contact pins collectively defining an upper contact section, a lower contact section and a compliant section connecting the upper and lower contact sections are disposed within the card edge connector housing and the substrate. The upper contact section has an open end with a restricted contact portion for contacting the card. The resilient, compliant section is disposed within the space and is configured to compress to absorb a force from the substrate that would otherwise be transmitted to the upper contact section via the lower contact section.

18 Claims, 4 Drawing Sheets

CONNECTOR WITH COMPLIANT SECTION

BACKGROUND

1. Technical Field

The present invention relates to the field of electrical connectors, more specifically defined as card edge connectors or card-receiving devices used in but not limited to the computer industry.

2. Background Information

A computing device may include several components, such as a memory, hard drive, processor, an electrical connector, etc. The electrical connector may be a card edge connector or a card-receiving device. A card having a functional purpose (e.g., network cards, sound cards, modems, extra ports such as USB or serial, TV tuner cards and disk controllers) may be inserted into the card edge connector. An improved card edge connector is desirable.

SUMMARY

In some embodiments of the present invention, an apparatus including a card edge contact system is provided. The card edge contact system includes a card edge connector housing having an open end for receiving a card, a plurality of side walls and a housing base portion connecting the side walls and having a plurality of openings. The card edge contact system further includes a substrate spaced a distance away from the housing base portion to form a space therebetween, and has a plurality of contact pin holes. The card edge contact system further includes a plurality of contact pins collectively defining an upper contact section, a lower contact section and a compliant section. The upper contact section has an open end with a restricted contact portion for contacting the card. A portion of the upper contact section is disposed within the openings in the housing base portion. The lower contact section has an end connected and secured to the substrate via the contact pin holes. The compliant section is electrically-conductive, resilient and disposed within said space. The compliant section has one end connected to the upper contact section and another end connected to the lower contact section. The compliant section is configured to absorb a force from the substrate that would otherwise be transmitted to the upper contact section via the lower contact section and allow the card edge connector housing to move in a free motion state and relative to the substrate.

Some embodiments of the present invention relate to a method of suppressing shock in a printed circuit board arrangement. A card edge connector housing is provided and has an open end and a housing base portion having openings. A printed circuit board (PCB) is providing and has an upper surface disposed a distance from a bottom surface of the card edge connector housing and forming a space therebetween. The PCB has a pair of contact pin holes. A pair of contact pins are provided and collectively define an upper contact section, a lower contact section and a compliant section. The upper contact section has an open end with a restricted contact portion for contacting the card. A portion of the upper contact section is disposed within the openings in the housing base portion. The lower contact section has an end connected and secured to the PCB via the contact pin holes. The compliant section is electrically-conductive, resilient and disposed within said space. The compliant section further has one end connected to the upper contact section and another end connected to the lower contact section. The compliant section is configured to absorb a force from the PCB that would otherwise be transmitted to the upper contact section via the lower contact section. A force from the PCB is absorbed within the compliant section to reduce a force transmitted to the upper contact section from the lower contact section by moving the card edge connector housing relative to the PCB.

Some embodiments of the present invention relate to a computing device that includes a card edge connector housing having an open end for receiving a card, side walls and a housing base portion connecting the walls and having openings. The computing device includes a card inserted into the card edge connector housing. The computing device further includes a printed circuit board (PCB) having an upper surface disposed a distance from a bottom surface of the card edge connector housing and forming a space therebetween. The PCB has a pair of contact pin holes. The computing device includes a pair of contact pins collectively defining an upper contact section, a lower contact section and a compliant section. The upper contact section has an open end with a restricted contact portion for contacting the card, a portion of the upper contact section being disposed within the openings in the housing base portion. The lower contact section has an end connected and secured to the PCB via the contact pin holes. The compliant section is electrically-conductive, resilient and disposed within said space. The compliant section further has one end connected to the upper contact section and another end connected to the lower contact section. The compliant section is configured to reduce a force transmitted from the lower contact section to the upper contact section. The computing device further includes a rigid member configured to be inserted between the PCB and the card edge connector housing. If a predetermined condition is met, the rigid member contacts both the card edge connector housing and the PCB such that the distance does not fluctuate. If the predetermined condition is not met, the rigid member does not contact at least one of the PCB and the card edge connector housing such that the distance fluctuates when force transmitted from the PCB is absorbed by the compliant section.

DETAILED DESCRIPTION

Figure 1:
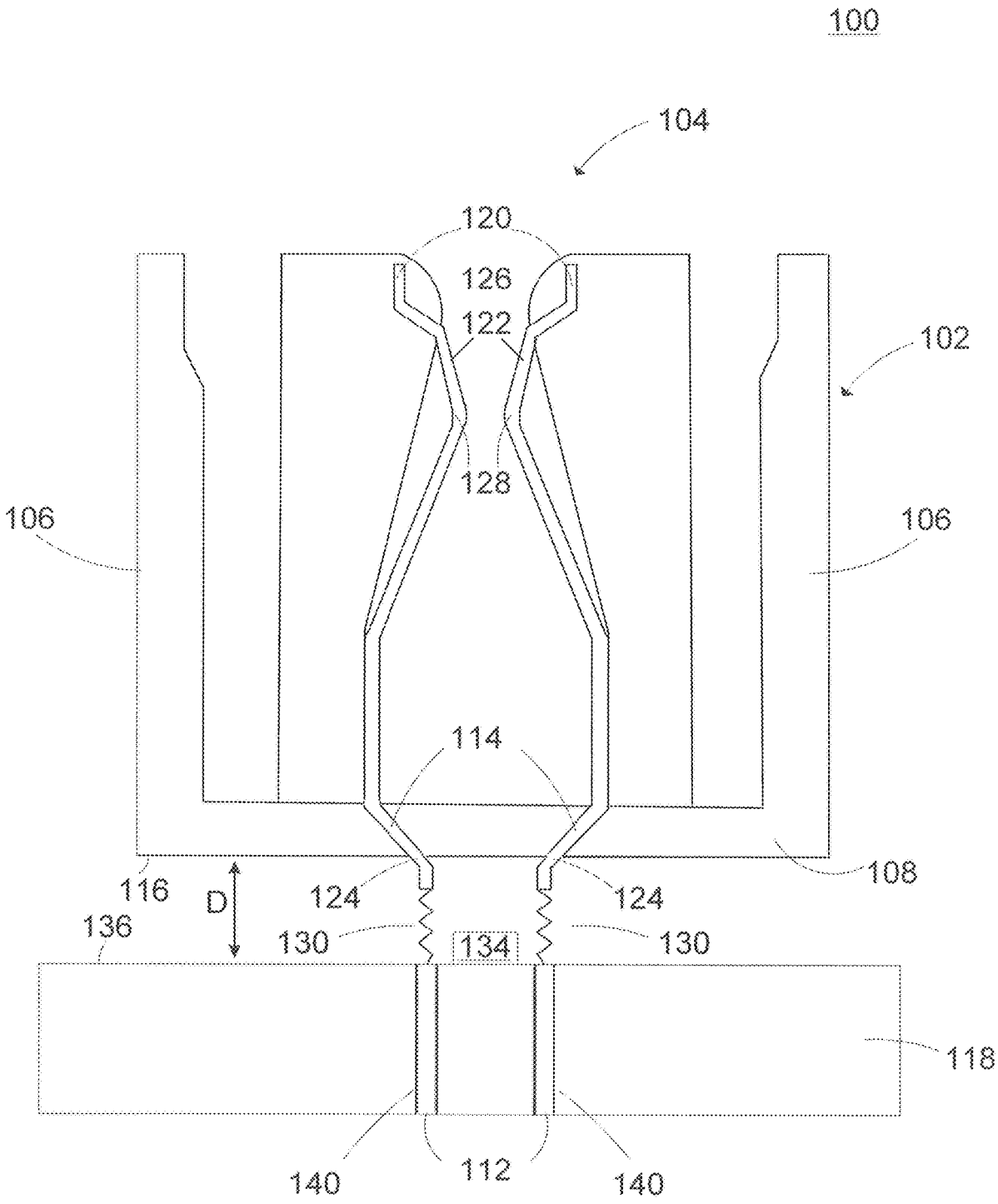
FIG. 1 illustrates a card edge contact system with a rigid member in an unengaged state.

A card edge contact system is provided in many computing devices, such as a server or a computer. A card edge contact system allows a card having a unique function to be connected to the computing device.

During the course of discovering the present invention, the inventors realized an improved system for a card edge contact system is desirable. A card edge contact system may receive one or more cards within a housing. The housing may be provided on and connected to a substrate (e.g., a printed circuit board) via a connector, such as a pin. The cards may be Peripheral Component Interconnect (PCI) cards such as a cable card, modem card, network card, sound card, modem, an extra port such as USB or serial, TV tuner cards and disk controllers.

The card edge contact system may include a female card edge connector that mates with a male connector of the card and forms an electrical connection with the card. The male connector of the card may have a connector that is formed of several layers, including gold, copper and nickel. The layers of gold, copper and nickel may be formed in that order from an outer to an inner part of the male connector.

Some computing devices, such as servers, are shipped to the customer after manufacturing and after a complete and thorough testing. During manufacturing, cards may be inserted into a card edge contact system within the computing device. Most manufacturers follow a "test-and-then-ship" philosophy, meaning that after the computing device is tested and proven to work correctly, the computing device is packed and shipped to the customer.

During shipment, the computing device may be subjected to various forces, including shocks and vibrations. Such forces may affect the computing device when handlers move the computing device or if the computing device is transported on a bumpy road.

If a sufficient force is applied to the computing device, the mated contacts of the card edge connector housing and the card move relative to each other. Depending on the magnitude of the force and the design of the computing device, these movements may be numerous and very large in amplitude.

A contact of a card has a wear life. In other words, gold plating from the contact is worn off each time there is relative movement between the male and female surfaces of the connectors. If there is sufficient aggregate motion during shipment of the computing device, the gold and the underlying layer of nickel are worn off, leaving copper within the mating area between the male and female connectors rather than gold. This is detrimental to the reliability of the contact interface, and failures may happen months or even weeks or days after the start of the system. In some instances, since the gold is worn away from the male connector, thereby decreasing the thickness of the male connector, a gap between the male and female connectors develops and proper contact may not be made.

The inventors discovered that a "compliant section" formed underneath the housing and connecting the housing to the substrate overcomes the above described problems. The compliant section may be formed to absorb shocks and vibrations generated during transit, such that relative motion between an inserted card and the housing may be reduced. For instance, a shock generated during transit may be transmitted to the substrate. The generated shock may then be transmitted to the compliant section where the shock may be absorbed before reaching the housing. The compliant section may be made of a resilient material such as a flexible cable or rigid spring to allow for relative movement between the housing and substrate. Accordingly, the housing and substrate may move relative to each other and a shock may be absorbed in the compliant section. In some cases, the housing and substrate may move horizontally relative to each other, and in some cases the housing and substrate may move vertically. In some cases, the housing and substrate may move horizontally and vertically relative to each other.

An engageable rigid member may also be disposed in the compliant section. When the compliant section needs to absorb shocks, the rigid member may be in an unengaged position and does not contact both the housing and the substrate.

When the compliant section no longer needs to absorb shocks, such as upon completion of shipment, the rigid member may be engaged to stop relative movements between the housing and substrate. When the rigid member is engaged, a more stable support is provided for the housing so that the housing does not move. Accordingly, if a card is to be removed or inserted into the housing, a stable support is provided without damaging the compliant section, housing, or card. The rigid member may include a pneumatic apparatus, a mechanically collapsible beam or wedge, or any other apparatus that may be selectively engaged to stop relative movements between the housing and substrate, and selectively disengaged to allow relative movement between the housing and substrate.

FIG. 1 illustrates some embodiments of the present invention. In FIG. 1, an apparatus, such as a computing device, including a card edge contact system 100 is illustrated. The card edge contact system 100 includes a card edge connector housing 102 having an open end 104 for receiving a card (not illustrated). The card edge connector housing 102 includes a plurality of side walls 106 and a housing base portion 108 connecting the side walls 106. The housing base portion 108 has a plurality of openings 114 to allow contact pins 120 to pass through the card edge connector housing 102.

A substrate 118 is disposed underneath the card edge connector housing 102. The substrate 118 may be a printed circuit board. The substrate 118 has a pair of contact pin holes 140. A space is formed between an upper surface 136 of the substrate 118 and a lower surface 116 of the card edge connector housing 102.

Contact pins 120 are provided within the card edge contact system 100. The contact pins 120 collectively form an upper contact portion 122. Between the pins 120 and in the upper contact portion 122 a cavity for receiving the card is defined. The upper contact portion 122 contacts the card at restricted portions 128 where the pair of pins 120 are bent inward toward each other. A card may be held firmly between contact pins 120 at the restricted portion 128. Cards of various sizes and outer dimensions may be inserted between the contact pins 120.

The contact pins 120 further collectively define a lower contact section 112. The lower contact section 112 has an end connected to and secured to the substrate 118 via the contact pin holes 140. The contact pins 120 are connected, as by soldering, to an appropriate circuit trace on the substrate 118 and/or in the holes 140 of the substrate 118.

Although the contact pins 120 herein have lower contact section 112 extending through holes 140 in the substrate 118, the lower contact section 112 could also be right-angled for surface connection to circuit traces on the top surface of the substrate 118, rather than extending through holes 140 of the substrate 118. Other means of connecting the lower contact section 112 to the circuit traces of substrate 118 are also within the scope of the invention.

A portion of the upper contact section 122 passes through openings 114 in the housing base portion 108 and connects to the compliant section 130 of the contact pins 120. The compliant section 130 is disposed within the space formed between card edge connector housing 102 and substrate 118. The compliant section 130 has one end connected to the portion of the upper contact section 122 that passes through the openings 114 the card edge connector housing 102. The compliant section 130 further has another end connected to an end of the lower contact section 112.

The compliant section 130 may be configured to absorb a force from the substrate 118 that would otherwise be transmitted to the upper contact section 122 via the lower contact section 112. In some embodiments, the compliant section 130 may be compressed or decompressed to absorb the force. Thus, when a card is disposed in the restricted contact portion 128, the compliant section 130 absorbs force from the substrate 118 and minimizes relative motion between the card and the restricted contact portion 128. The compliant section 130 allows the card edge connector housing 102 to remain in a "free motion" state, and absorbs vibrations. Free motion may mean that the card edge connector housing 102 is free to move in any direction (e.g., vertically, horizontally, horizontally and vertically at the same time, etc.).

The compliant section 130 may be formed from a flexible cable, or a rigid spring. The compliant section 130 may be formed of a different material than upper contact section 122 and the lower contact section 112. Furthermore, the dimensions of compliant section 130 may be different than upper contact section 122 and the lower contact section 112. For instance, a thickness of the compliant section 130 may be different than thicknesses of the upper contact section 122 and the lower contact section 112. Furthermore, the compliant section 130 may not be uniformly straight in one direction or is non-linear. Instead, compliant section 130 may have a "zig-zag" shape or a spring shape.

When the card edge contact system 100 experiences a force, such as a sudden shock, the compliant section 130 may be designed to absorb the force. For instance, without compliant section 130, a force would normally be transmitted from the substrate 118 to the card edge connector housing 102 via contact pins 120 that connect the substrate 118 and the card edge connector housing 102. The compliant section 130 may also be formed of an electrically conductive material to facilitate the transmission of electrical signals between the upper contact section 122 and the lower contact section 112, and to an inserted card.

Due to the compliant section 130, a distance D between the upper surface 136 of the substrate 118 and the lower surface 116 of the card edge connector housing 102 may fluctuate. For instance, if a force is applied to the substrate 118, the substrate 118 may move towards the card edge connector housing 102. The compliant section 130 may then compress due to the movement of the substrate 118, while the card edge connector housing 102 does not move, or moves a smaller distance than the substrate 118. When the force is no longer applied to the substrate 118, the substrate 118 may move away from the card edge connector housing 102, thereby changing the distance D, and the compliant section 130 may also decompress. Similarly, the compliant zone 130 may stretch to absorb a force from substrate 118 if the substrate 118 moves away from the card edge connector housing 102.

In some embodiments, the compliant zone 130 may move horizontally to allow the substrate 118 and the card edge connector housing 102 to move horizontally relative to each other. In some embodiments, the substrate 118 may move in a parallel direction to a movement of the card edge connector housing 102. In some embodiments, the distance D does not fluctuate, but instead the card edge connector housing 102 moves horizontally relative to the substrate 118.

Accordingly, when a force is absorbed in the compliant section 130, the distance D between the card edge connector housing 102 and the substrate 118 may become smaller. In a state of rest, or when no force is applied to substrate 118, the distance D does not substantially fluctuate. The distance D may only fluctuate when a force applied to substrate 118 changes.

In some embodiments, the compliant section 130 may extend between the top surface 136 of the substrate 118 to the bottom surface 116 of the card edge connector housing 102, and through the entire distance D. In some embodiments, the compliant section 130 may only extend through a portion of the distance D. The size of the compliant section 130 may be directly proportional to the amount of force the compliant section 130 may absorb.

In some embodiments, a rigid member 134, such as an inflatable bladder or a collapsible beam, may be disposed within the space between the card edge connector housing 102 and substrate 118.

Figure 2:
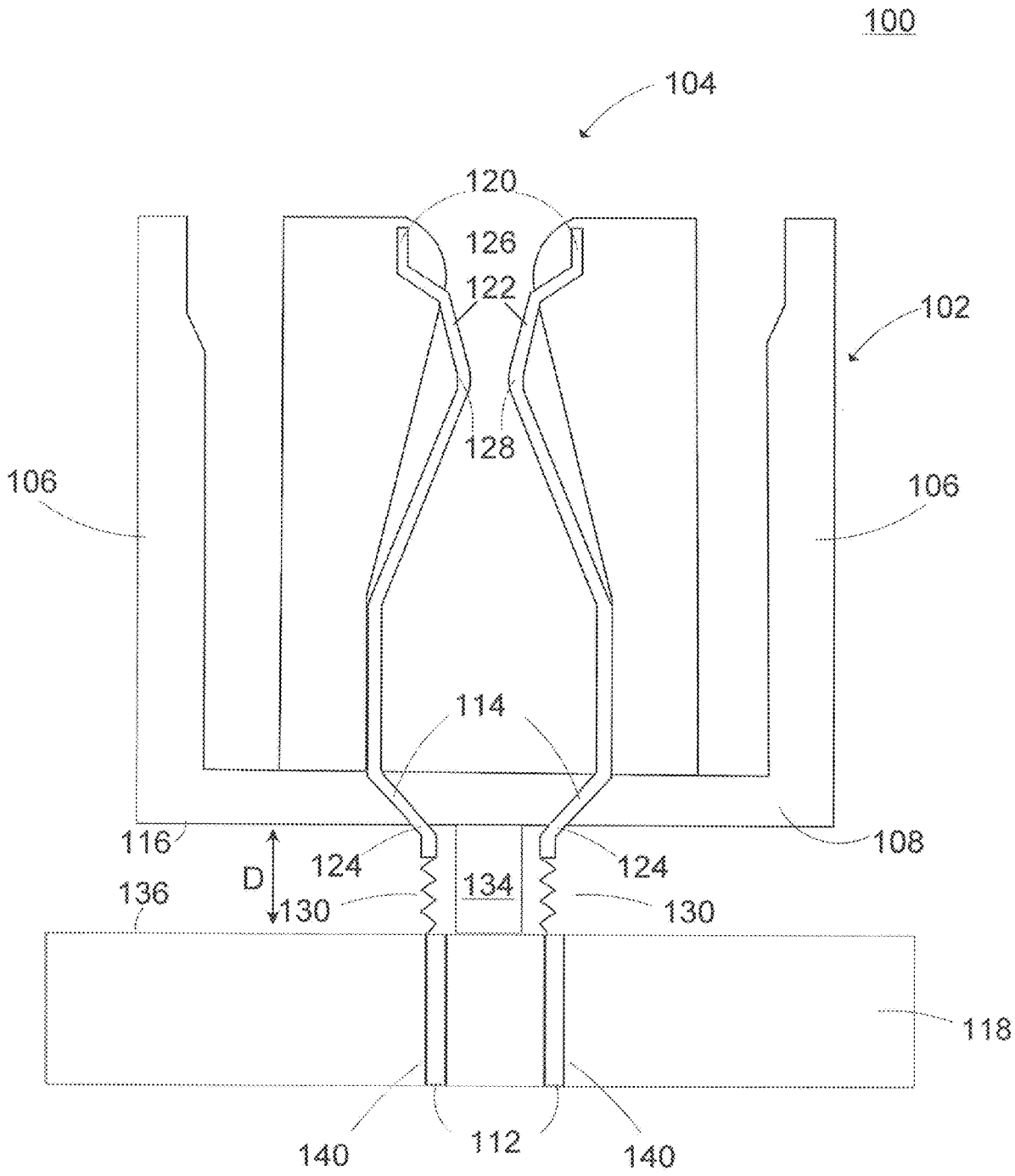
FIG. 2 illustrates a card edge contact system with a rigid member in an engaged state.

FIG. 2 illustrates the rigid member 134 in an engaged state. If a predetermined condition is met, the rigid member 134 enters the engaged state and contacts both the lower surface 116 of the card edge connector housing 102 and the upper surface 136 of the substrate 118. With reference to FIG. 1, if the predetermined condition is not met, the rigid member 134 enters an unengaged state and does not contact at least one of the lower surface 116 of the card edge connector housing 102 and the upper surface 136 of the substrate 118.

Again with reference to FIG. 2, in an engaged state, the rigid member 134 provides support between the card edge connector housing 102 and the substrate 118. Accordingly, in the engaged state, the rigid member 134 reduces or prevents relative movement between the card edge connector housing 102 and the substrate 118. In contrast, in the unengaged state the rigid member 134 allows for relative movement between the card edge connector housing 102 and the substrate 118.

During shipment or at other times when a force may be applied to the card edge contact system 100, the rigid member 134 may be in an unengaged state to allow the compliant section 130 to absorb such forces so that the card edge connector housing 102 is in a free-motion state. At other times, the rigid member 134 may be in an engaged state such that the compliant section 130 no longer absorbs such forces. In the engaged state, the rigid member 134 serves as a stable support for card edge connector housing 102. An engaged state of the rigid member 134 may be desirable when the compliant section 130 is no longer needed, such as during use of the computing device the card edge contact system 100 is disposed within. The rigid member 134 may also enter into an engaged state to prevent damage to the compliant section 130 due to excessive compression or decompression of the compliant section 130, such as when a card is inserted or removed from the card edge contact system 100.

In some embodiments, a user of the computing device may manually engage rigid member 134 using an actuating means, such as a switch or a button. In some embodiments, a user may directly access the rigid member 134 and manipulate the dimensions of the rigid member 134 such that the rigid member 134 contacts both the card edge connector housing 102 and substrate 118. For instance, the user may open the casing of the computing device to directly access the rigid member 134. A height of the rigid member 134 may then be adjustable by the user, and the user may select an appropriate height.

In some embodiments, the rigid member 134 may automatically enter into an engaged state when a predetermined condition is met indicating that the card edge contact system 100 is no longer likely to experience significant forces, or that the compliant section 130 should be protected from undergoing excessive compression or decompression. The predetermined condition may include power being provided to the computing device the housing 100 is disposed within. In some embodiments, the predetermined condition may include opening of a casing of a computing device that the housing 100 is disposed within, indicating the user intends on inserting or removing a card from the housing 100.

The rigid member 134 is illustrated as being between the contact pins 112. However, the rigid member 134 may be placed anywhere between card edge connector housing 102 and substrate 118 to provide support therebetween when engaged.

In some embodiments, in an unengaged state the rigid member 134 serves as a "stopper." For instance, a distance between the bottom surface 116 of the card edge connector housing 102 and the unengaged rigid member 134 may be selected to prevent excessive free motion of the card edge connector housing 102. If the card edge connector housing 102 contacts the top surface of the unengaged rigid member 134 during free motion, the unengaged rigid member 134 may stop further movement of the card edge connector housing 102 towards the substrate 118. Accordingly, the compliant section 130 may only be compressed in the space between the card edge connector housing 102 and the top surface of the unengaged rigid member 134.

Furthermore, in some embodiments, the compliant section 130 may only extend between a top most portion of rigid member 134 in an unengaged state to the bottom surface 116 of the card edge connector housing 102. In this manner, the distance of the compliant section 130 may be shortened and the free motion of the card edge connector housing 102 may be further controlled.

In some embodiments, the rigid member 134 may be disposed on the card edge connector housing 102 rather than the substrate 118. If the rigid member 134 is disposed on the card edge connector housing 102 rather than the substrate 118, the above described functions of the rigid member 134 may still be accomplished by reversing the roles of the substrate 118 and card edge connector housing 102 described above with respect to the rigid member 134.

Figure 3:
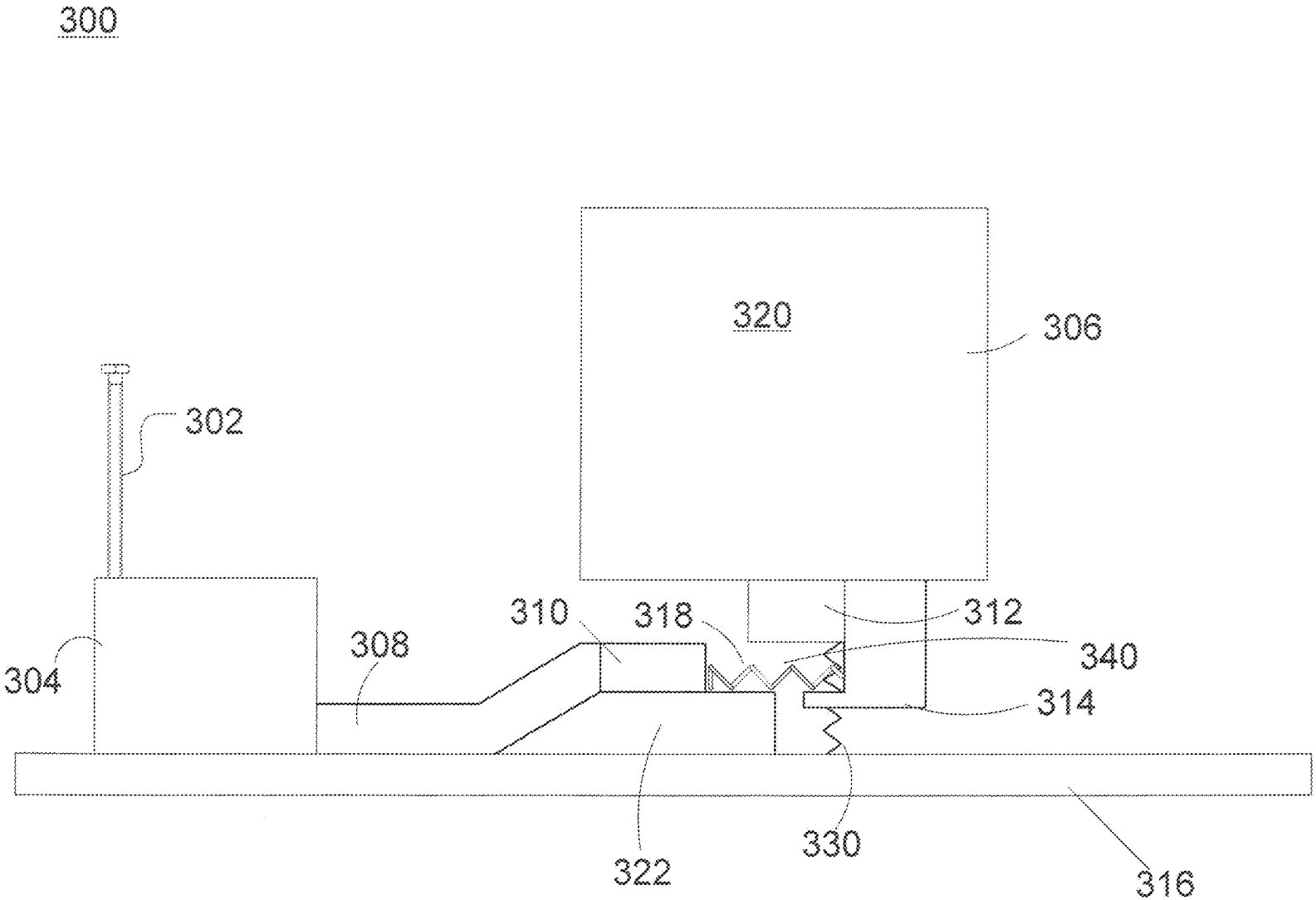
FIG. 3 illustrates a card edge contact system with a sliding member in an unengaged state.

With reference to FIG. 3, in some embodiments, in addition to or to replace the rigid member 134 altogether, a sliding member 310 may be provided that may be moved underneath a card edge contact system 306. Card edge contact system 306 is similar to the card edge contact system 100 described above and with reference to FIGS. 1-2, except that a rigid member 134 need not be provided as the sliding member 310 may provide support when needed. The sliding member 310 may provide support to card edge contact system 306 in similar situations to when the rigid member 134 provides support for card edge connector housing 102.

A side wall of a card edge connector housing 320 of the card edge contact system 306 is illustrated. A portion of the compliant section 330 of the card edge contact system 306 is illustrated behind a spring 318 and a base 314. The compliant section 330 may be positioned underneath contact pins and within a contact pin field, while the sliding member 310 may be positioned outside of such a contact pin field.

A protrusion 312 from the card edge connector housing 320 is disposed above an aperture 340. The aperture 340 receives the sliding member 310. When the sliding member 310 slides into the aperture 340, movement between the card edge connector housing 320 and substrate 316 may be limited. In some embodiments, the aperture 340 is "c-shaped."

A spring 318 may be coupled to the base 314. In a resting state, the base 314 does not contact a top surface of the substrate 316 so that the card edge connector housing 320 may freely move relative to the substrate 316. In some embodiments, the base 314 may contact a support structure 322.

Figure 4:
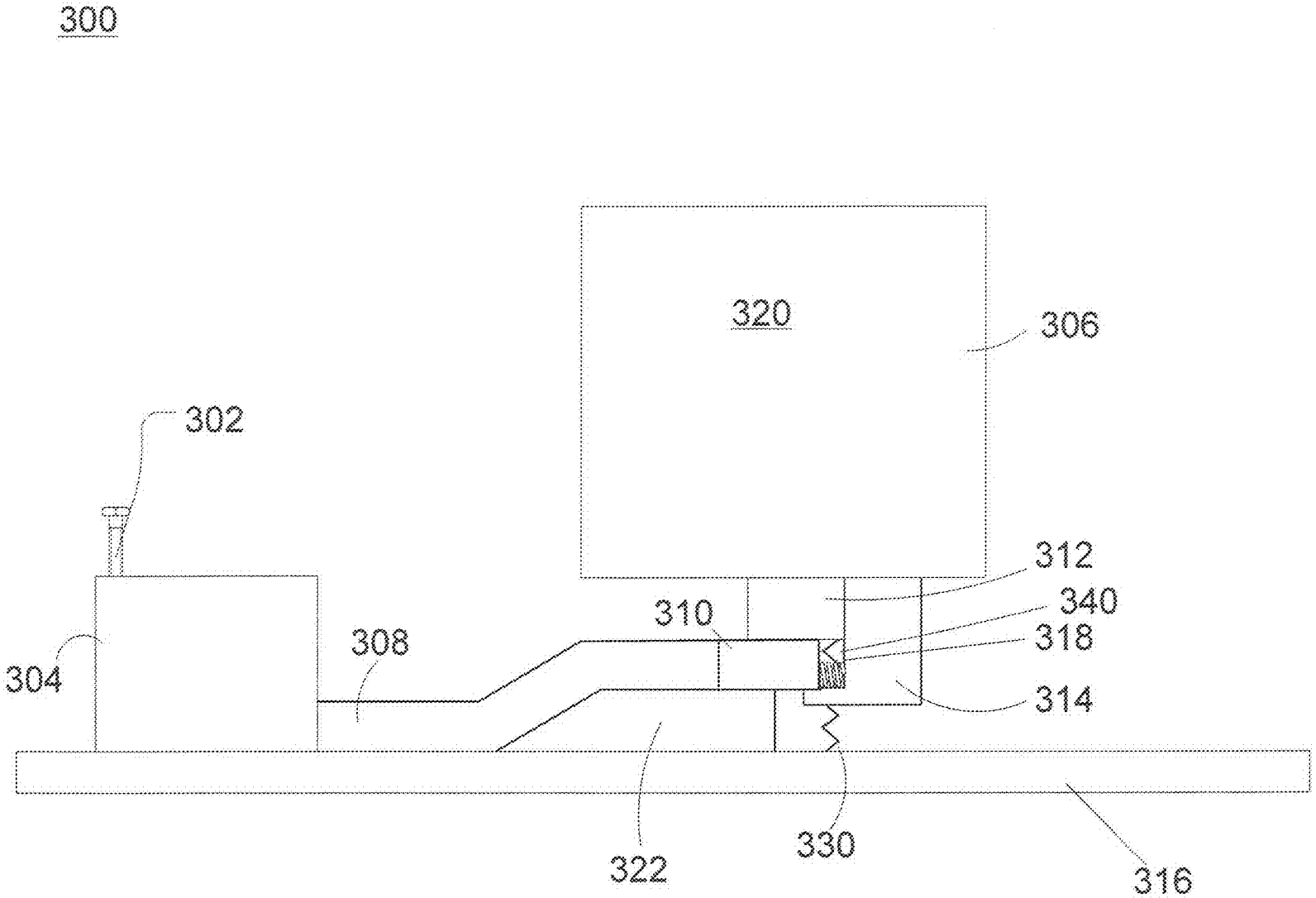
FIG. 4 illustrates a card edge contact system with a sliding member in an engaged state.

The spring 318 biases the sliding member 310 away from the aperture 340 with a biasing force. A screw 302 may be provided to a cam 304. The cam 304 includes a portion 308 that is coupled to the sliding member 310. As illustrated in FIG. 4, when the screw 302 is turned in a first direction, the cam 304 advances portion 308 to apply a force to the sliding member 310 and inserts the sliding member 310 into the aperture 340 against the biasing force of the spring 318. As illustrated in FIG. 3, if the screw 302 is turned in a second direction opposite the first direction, the portion 308 of the cam 304 recedes into cam 308, and the biasing force of the spring 318 causes the sliding member to retract from the aperture 340.

The sliding member 310 may be disposed on the support structure 322. The support structure 322 provides support for the sliding member 310 and also has a smaller friction coefficient than the substrate 316. The support structure 322 provides a smooth surface for the sliding member 310 to move along, and guides the sliding member 310 into the aperture 340.

In some embodiments, the sliding member 310 may be made of a rigid material, while portion 308 of the cam 304 is made of a resilient, flexible material.

It should be understood, however, that the invention is not necessarily limited to the specific arrangement and components shown and described above, but may be susceptible to numerous variations within the scope of the invention.

It will be apparent to one skilled in the art that the manner of making and using the claimed invention has been adequately disclosed in the above-written description of the preferred embodiments taken together with the drawings.

It will be understood that the above description of the preferred embodiments of the present invention are susceptible to various modifications, changes, and adaptations, and the same are intended to be comprehended within the meaning and range of equivalents of the appended claims.

What is claimed is:

1. An apparatus including a card edge contact system, the apparatus comprising:

a card edge connector housing having an open end for receiving a card, a plurality of side walls and a housing base portion connecting the side walls and having a plurality of openings;

a substrate spaced a distance away from the housing base portion to form a space therebetween, and having a plurality of contact pin holes;

a plurality of contact pins collectively defining an upper contact section, a lower contact section and a compliant section, the upper contact section having an open end with a restricted contact portion for contacting the card, a portion of the upper contact section disposed within the openings in the housing base portion, the lower contact section having an end connected and secured to the substrate via the contact pin holes, the compliant section being electrically-conductive, resilient and disposed within said space, the compliant section further having one end connected to the upper contact section and another end connected to the lower contact section, the compliant section configured to absorb a force from the substrate that would otherwise be transmitted to the upper contact section via the lower contact section and allow the card edge connector housing to move in a free motion state and relative to the substrate;

a sliding member;

a protrusion from the card edge connector housing disposed above an aperture for receiving the sliding member;

a spring coupled to the sliding member and biasing the sliding member away from the aperture with a biasing force;

a screw; and a cam coupled to the sliding member that receives the screw, the screw being turnable in a first direction to advance the cam to apply a force to the sliding member and insert the sliding member into the aperture against the biasing force and into contact with the protrusion, and the screw being turnable in a second direction opposite the first direction to retract the cam so that the biasing force causes the sliding member to retract from the aperture such that the sliding member does not contact the protrusion.

2. The apparatus of claim 1, wherein the compliant section is a rigid spring.

3. The apparatus of claim 1, wherein the compliant section is a flexible cable.

4. The apparatus of claim 1, wherein the compliant section allows the distance to fluctuate depending on the absorbed force.

5. The apparatus of claim 4, wherein the space becomes smaller when a sufficient force is applied to the substrate.

6. The apparatus of claim 1, wherein the compliant section extends through the entire space.

7. The apparatus of claim 1, wherein the card is disposed in the restricted contact portion, and the compliant section absorbs force from the substrate such that relative motion between the card and the restricted contact portion is reduced.

8. A method of suppressing shock in a printed circuit board arrangement, the method including:

providing a card edge connector housing having an open end and a housing base portion having openings;

providing a printed circuit board (PCB) having an upper surface disposed a distance from a bottom surface of the card edge connector housing and forming a space therebetween, the PCB having a pair of contact pin holes;

providing a pair of contact pins collectively defining an upper contact section, a lower contact section and a compliant section, the upper contact section having an open end with a restricted contact portion for contacting a card, a portion of the upper contact section disposed within the openings in the housing base portion, the lower contact section having an end connected and secured to the PCB via the contact pin holes, the compliant section being electrically-conductive, resilient and disposed within said space, the compliant section further having one end connected to the upper contact section and another end connected to the lower contact section, the compliant section configured to absorb a force from the PCB that would otherwise be transmitted to the upper contact section via the lower contact section;

absorbing a force from the PCB within the compliant section to reduce a force transmitted to the upper contact section from the lower contact section by moving the card edge connector housing relative to the PCB; and if a cam is activated, sliding a sliding member into an aperture between a protrusion of the card edge connector housing and a support surface for the sliding member.

9. The method of claim 8, wherein the distance fluctuates when a force is applied to the PCB and the cam is not activated.

10. A method of suppressing shock in a printed circuit board arrangement, the method including:

providing a card edge connector housing having an open end and a housing base portion having openings;

providing a printed circuit board (PCB) having an upper surface disposed a distance from a bottom surface of the card edge connector housing and forming a space therebetween, the PCB having a pair of contact pin holes;

providing a pair of contact pins collectively defining an upper contact section, a lower contact section and a compliant section, the upper contact section having an open end with a restricted contact portion for contacting a card, a portion of the upper contact section disposed within the openings in the housing base portion, the lower contact section having an end connected and secured to the PCB via the contact pin holes, the compliant section being electrically-conductive, resilient and disposed within said space, the compliant section further having one end connected to the upper contact section and another end connected to the lower contact section, the compliant section configured to absorb a force from the PCB that would otherwise be transmitted to the upper contact section via the lower contact section;

absorbing a force from the PCB within the compliant section to reduce a force transmitted to the upper contact section from the lower contact section by moving the card edge connector housing relative to the PCB;

if a predetermined condition is met, contacting both the card edge connector housing and the PCB with a rigid member in an engaged state; and if the predetermined condition is not met, contacting only one of the card edge connector housing and the PCB with the rigid member in an unengaged state.

11. The method of claim 10, wherein the predetermined condition is whether power is provided to the apparatus.

12. A computing device comprising:

a card edge connector housing having an open end for receiving a card, side walls and a housing base portion connecting the walls and having openings;

a printed circuit board (PCB) having an upper surface disposed a distance from a bottom surface of the card edge connector housing and forming a space therebetween, the PCB having a pair of contact pin holes;

a pair of contact pins collectively defining an upper contact section, a lower contact section and a compliant section, the upper contact section having an open end with a restricted contact portion for contacting the card, a portion of the upper contact section disposed within the openings in the housing base portion, the lower contact section having an end connected and secured to the PCB via the contact pin holes, the compliant section being electrically-conductive, resilient and disposed within said space, the compliant section further having one end connected to the upper contact section and another end connected to the lower contact section, the compliant section configured to reduce a force transmitted from the lower contact section to the upper contact section; and a rigid member configured to be inserted between the PCB and the card edge connector housing, and if a predetermined condition is met, the rigid member contacts both the card edge connector housing and the PCB, and if the predetermined condition is not met, the rigid member does not contact at least one of the PCB and the card edge connector housing.

13. The computing device of claim 12, wherein if the predetermined condition is met, the rigid member does not allow the card edge connector housing to move relative to the PCB such that the distance does not fluctuate, and if the predetermined condition is not met, the rigid member allows the card edge connector housing to move relative to the PCB such that the distance fluctuates when force transmitted from the PCB is reduced by the compliant section.

14. The computing device of claim 13, wherein the predetermined condition is whether power is provided to the computing device.

15. The computing device of claim 12, wherein the rigid member is disposed between the contact pins.

16. The computing device of claim 12, wherein the rigid member is an inflatable bladder.

17. The computing device of claim 12, wherein the rigid member is a collapsible beam.

18. The computing device of claim 12, wherein the card is inserted into the card edge connector housing.

* * * * *